US011808022B1

(12) United States Patent
Perez et al.

(10) Patent No.: US 11,808,022 B1
(45) Date of Patent: Nov. 7, 2023

(54) TOILET WATER FLUSHING BUTTON COVER BOX

(71) Applicants: Ariel Arnaldo Perez, Moreno (AR); Nicolás Martín Biach, Ituzaingó (AR)

(72) Inventors: Ariel Arnaldo Perez, Moreno (AR); Nicolás Martín Biach, Ituzaingó (AR)

( * ) Notice: Subject to any disclaimer, the term of this patent is extended or adjusted under 35 U.S.C. 154(b) by 0 days.

(21) Appl. No.: 18/132,597

(22) Filed: Apr. 10, 2023

(51) Int. Cl.
*E03D 5/02* (2006.01)

(52) U.S. Cl.
CPC ..... *E03D 5/026* (2013.01)

(58) Field of Classification Search
CPC .... E03D 5/026; A47K 13/242; A47K 13/245; A47K 17/00
USPC ..... 70/232, 178, 158
See application file for complete search history.

(56) References Cited

U.S. PATENT DOCUMENTS 4,319,368 A * 3/1982 Peters ..... E03D 5/026 4/415
4,519,105 A * 5/1985 Blanck ..... A47K 13/10 4/246.1
5,435,016 A * 7/1995 Smith ..... A47K 13/24 4/234
10,156,063 B2 * 12/2018 Barish ..... E03D 5/09
2018/0338651 A1 * 11/2018 Burtt ..... F16M 13/022
2019/0374076 A1 * 12/2019 deLoache, III ..... A47K 13/242

* cited by examiner

*Primary Examiner* — Erin Deery
(74) *Attorney, Agent, or Firm* — Mariana I. Vernieri

(57) ABSTRACT

A Cover Box toilet accessory that contributes to preventive medicine, improves global health, reduces the spread of diseases, and fights the environmental pollution caused by the emission of infectious and polluting bioaerosols during toilet flushing. The Cover Box is designed to fit over the Water Flushing Button of a conventional toilet and includes a Fixed Base and a Sliding Top with transparent or translucent parts. The Fixed Base includes Fitting Guides and a tension spring. By obstructing the direct access to the Water Flushing Button, this Cover Box forces the user to close the toilet lid before flushing, since the movement of the Sliding Top to reveal the button also indirectly closes the toilet lid, reducing the emission of bioaerosols that can spread diseases and cause environmental pollution. The system has a high global impact and can be used in various settings, having a significant impact on public health.

2 Claims, 5 Drawing Sheets

FIG. 11
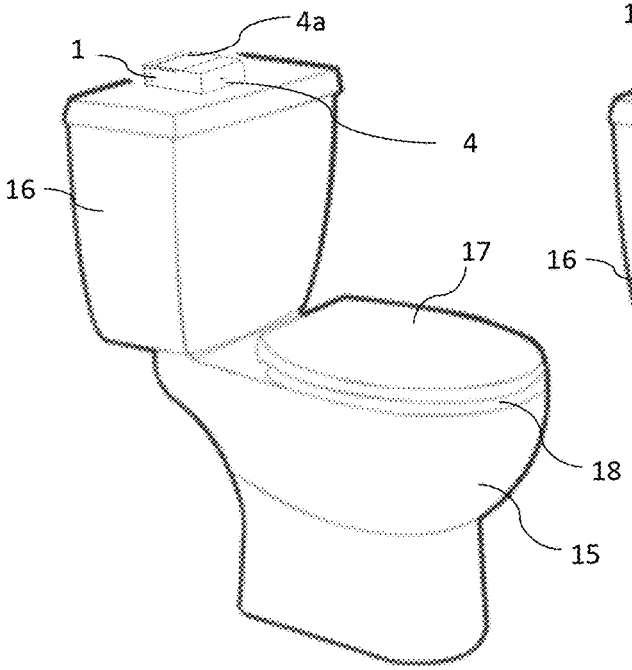
FIG. 12
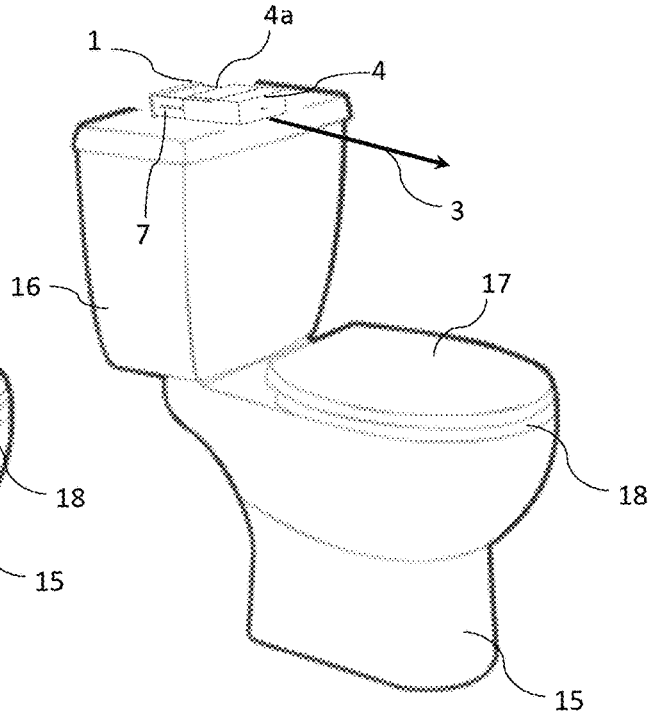
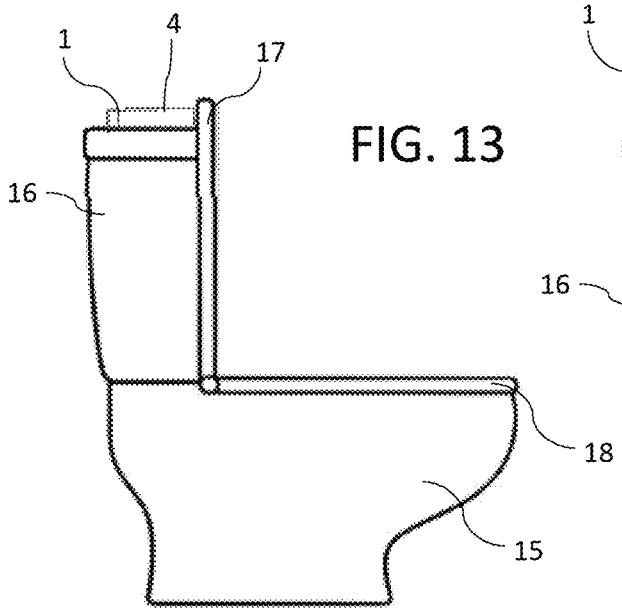
FIG. 13
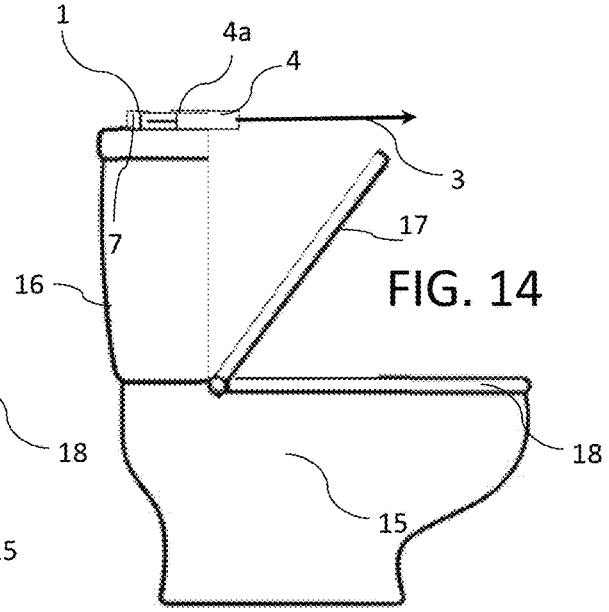
FIG. 14

TOILET WATER FLUSHING BUTTON COVER BOX

CROSS-REFERENCE TO RELATED APPLICATION

The present application is related to co-pending application Ser. No. 18/132,584, filed on the same date as the present application by the same applicants and inventors, which is incorporated by reference herein in its entirety and hereinafter referred to as "Patent Application 1"

FIELD OF THE INVENTION

This invention relates to the field of toilet lid and seat closure mechanisms and flushing systems. More specifically, it refers to a Cover Box for the Water Flushing Button, designed to force the user to close the lid or the lid and seat of the toilet in order to uncover the Water Flushing Button, thus eliminating the problem of emitting the outgoing and upward column of "infectious" bioaerosols, which are highly polluting and composed of water particles, fecal matter, urine, all kinds of pathogenic germs (bacteria, viruses, etc.).

BACKGROUND OF THE INVENTION

The emission of bioaerosols after a toilet flush was first studied in the 1950s, when a bacterium was "sowed" in various types of toilets and the bioaerosols produced during the flush were measured. The cultured particles could be trapped in the air 8 minutes after flushing and they were detected at a height of 150 cm from the ground. Toilet flushes produce infectious bioaerosols, small enough to be directly inhaled by the person releasing the flush (microscopic), entering deeply into the lungs, being able to cause contagion by pathogenic germs from third parties and even self-infection. They may remain in the environment for long periods of time (hours, days and even months) and may be transported by air currents. Cross contamination occurs to all kinds of surrounding environments. In addition, pathogens can be transmitted through all kinds of inanimate objects (fomites) on all bathroom surfaces, by indirect contact (infected hands touch the mucous membranes of the mouth, nose or eyes, generating contagion).

This means that there is a very serious risk of spreading infectious germs present in the toilet up to 4 and a half meters away. If there is a family member with a mild, serious or fatal illness, the toilet flush causes splashes, invisible to human sight, or particle aerosol that can be inhaled, come in contact with the mucosa of the eyes-nose-mouth, or deposited on contact surfaces around the bathroom, producing imminent contagion.

By not closing the toilet lid, pathogenic germs are deposited on absolutely all surfaces and/or fomites inside the bathroom, they remain on your body, on your cell phone, and can be transported to environments where there is food and other objects. It is definitely bad for health. Urine is also dangerous, as it can transmit infectious agents when it comes into contact with the mucous membranes of the eyes-nose-mouth. The process that occurs when flushing, lowering the toilet lid, and in which an "infectious microbial bomb" explodes and disperses with the swirling water, is called: "Toilet plume", causing a huge cloud of particles that splash all over the bathroom. The toilet can contain urine, blood, sperm, feces, viruses, bacteria, fungi, vomit, thousands of infectious agents, which are capable of transmitting diseases, such as hepatitis A, B, E, tuberculosis, gastritis, cholera, dysentery, salmonellosis, shigellosis, amoebiasis, giardiasis, COVID-19 and many other diseases. It is noteworthy that enteric and gastroenteric diseases are the main cause of death of children from 0 to 6 years of age worldwide.

The World Health Organization warned that diseases can be spread through fomites (examples of surfaces contaminated by not lowering the lid: floor, bidet, mirrors, faucets, door, walls, towels, shower curtain, sink, label handle door, toothbrushes, combs, toilet paper). If an object is contaminated with a pathogen such as a virus, it is capable of being transferred from one individual to another when they touch it with their hands and later make contact with the mucous membranes of the eyes-nose-mouth. For these reasons, the WHO recommends lowering the toilet lid. In addition, data from the United Nations and the World Health Organization report that 600 million families share a toilet with other families worldwide. COVID-19 is spread in the feces of infected people, which helps explain why it spreads so quickly. Feces are another contagion vehicle, in addition to the airway. The finding of live virus particles in stool samples indicates a fecal-oral route. The virus was found in oral, anal, and blood swabs. This indicates that infected patients, both symptomatic and asymptomatic, are capable of eliminating the pathogen through the fecal-oral route and causing contagion.

Despite the efforts of the prior art to address the issue of the emission of bioaerosols after a toilet flush, these solutions have several shortcomings, due to the fact that more than 98% of the world's population does not manually lower the toilet lid before flushing. For example, the Loomate system, available on the website https://www.loomate.com/, uses a sensor to detect the user's hand when the user is about to activate the toilet cistern, and uses a timer to activate a closing mechanism 20 seconds after use. However, the only thing this system closes is the seat, not the lid, as the purpose of this device is not to address the issue of bioaerosol emission during flushing, but rather to address a different problem: men forgetting to put the seat down, which is a nuisance for women in the household and can cause numerous daily conflicts.

Similarly, on some ships and airplanes, as well as on land vehicles that have toilets and chemical toilets, it is common to emphasize that the lid must be closed before flushing, not so much for health reasons but for safety, since in these systems, which work with vacuum and toxic chemicals, it is not safe to start flushing with the lid open. Therefore, it is common to find this type of design on cruise ships, where the Water Flushing Button is located behind the lid, forcing the user to close the lid to uncover the Water Flushing Button. However, this type of design must come factory-installed and cannot be easily adapted to a traditional vertical cistern toilet (with the Water Flushing Button on top of the cistern), which are very common models. Unlike this case, which would require replacing existing toilets with new ones with a different flushing system, a Cover Box for the Water Flushing Button allows for easy installation on the upper part of the cisterns of existing toilets all over the world in a much more practical and economical way.

For these reasons, we believe that providing a protective Cover Box for the Water Flushing Button, which allows the Water Flushing Button to be visible so that the user instinctively knows where it is and what needs to be done to release it, and which indirectly requires the need to close the toilet lid (or lid and seat) in order to release the Water Flushing Button and activate it, is a way to address the problem of bioaerosol emission by ensuring that the toilet lid is properly closed before flushing, thus constituting a solution to a long-standing, unresolved problem and need, and advancing the field. Even more so if the system is easy to install and use, with simple and intuitive operation, is durable and requires minimal maintenance, is also aesthetically pleasing and can be easily adapted to different bathroom decorations.

SUMMARY OF THE INVENTION

The presented Cover Box is a toilet accessory adapted to the normal functioning of a conventional toilet with a top Water Flushing Button. It comprises two main parts: a Fixed Base made of acrylic material and a Sliding Top including a Transparent Acrylic Sliding Plaque, an Opaque Acrylic Sliding Plaque, two Sliding Side Walls, and a Sliding Front. In some embodiments, the materials may not necessarily be acrylic, but it is highly recommended that the Sliding Top has a transparent or at least translucent part so that the Water Flushing Button can be seen through it, and its use is therefore evident. The Fixed Base is designed to be adjustable to the different measurements of any type and model of toilet cistern and lid and includes two Fitting Guides to guide the Sliding Top in its movement and a tension spring to ensure the Sliding Top returns to its place after release. Instead of a spring, another mechanism with suitable resistance, such as elastic bands, can be used for this purpose. When a user slides the Sliding Top to reach the Water Flushing Button and effect the water flush, this action indirectly first closes the toilet lid by colliding with it and causing it to fall, implementing the habit of closing the lid before pressing the Water Flushing Button.

The Cover Box is an improvement to the conventional system of toilets with top Water Flushing Buttons and can be applied to existing toilets in a simple and economical way by just adhering the Cover Box covering the Water Flushing Button, ensuring beforehand that the chosen Cover Box size is suitable for the toilet in question. This is verified if, when sliding the Sliding Top to uncover the Water Flushing Button, the front of the Sliding Top touches the toilet lid and pushes it to close. Some Cover Box models may include additional parts attached to the front of the Sliding Top to favor contact with the toilet lid, such as a curved rubber finish.

The Cover Box is comprised of a Fixed Base, a Sliding Top that includes a transparent or translucent material so that the Water Flushing Button can be seen through it, Fitting Guides on the interior sides of the Fixed Base of the Cover Box for the Sliding Top movement, a Sliding Fitting on the Sliding Side Walls to slide through the Fitting Guides, a Placement Base to adhere the Cover Box to the toilet cistern, and a Tension Spring or similar mechanism with its respective Support and Stopper to make the lid return to its initial position when the user releases it.

High Global Impact on Public and Private Health

Four main objectives of the system are to contribute to preventive medicine, to improve the health of the entire population worldwide, (global impact), to avoid contagion of diseases and in many cases deaths by avoiding contagions, and to generate a high impact in the fight against environmental pollution that in this particular case affects the entire built environment (intra-environmental, intra-hospital, intra-buildings in general, etc.) The benefit is for everyone: public restrooms, homes, shopping malls, business, restaurants, hospitals, hotels, airplanes, schools, universities, cruises and more.

The system substantially reduces the emission of bioaerosols by closing the lid and seat, (or just the lid if the seat is already down), before flushing the toilet, as the seat is also complemented with a sealing rubber on the toilet bowl and the lid with a sealing rubber bellows against the seat, acting as a hermetic and antimicrobial barrier. Other materials with specific characteristics that offer the hermetic function that was mentioned earlier can also be incorporated. An accessory handle on the proximal end of the seat is also considered so that it can be raised without contact on it. It could be made of stainless steel, for example, to facilitate its sanitization and avoid disease transmission.

When the toilet is flushed, the water and waste in the bowl are forced out through the drainpipe, and the closing of the helps to contain the bioaerosols within the toilet bowl and prevent them from being released into the air. This system, which can leave the factory already incorporated into new toilets, can also be used and marketed as an independent accessory to be adapted to the hundreds of millions of existing toilets worldwide.

BRIEF DESCRIPTION OF THE DRAWINGS

FIG. 11 is a perspective view of an embodiment of the closed Cover Box applied to a traditional toilet with a top Water Flushing Button and cistern, according to the present invention.

FIG. 12 is a perspective view of an embodiment of the open Cover Box applied to a traditional toilet with a top Water Flushing Button and cistern, according to the present invention.

FIG. 13 is a side view of an embodiment of the closed Cover Box applied to a traditional toilet with a top Water Flushing Button and cistern, according to the present invention.

FIG. 14 is a side view of an embodiment of the open Cover Box applied to a traditional toilet with a top Water Flushing Button and cistern, according to the present invention.

DETAILED DESCRIPTION OF THE INVENTION

Figure 1:
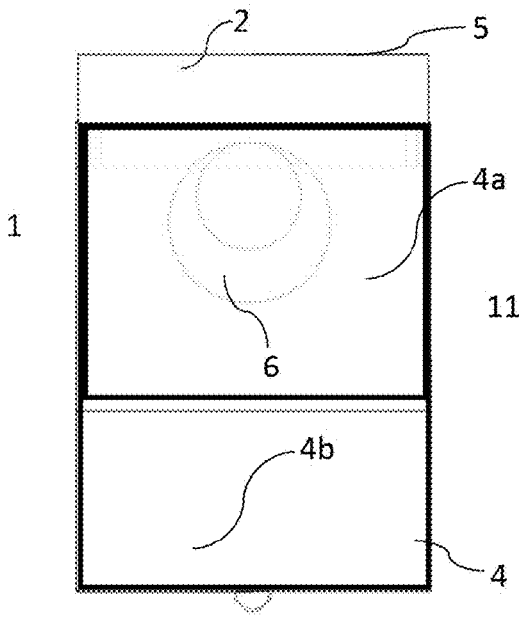
FIG. 1 is a rear view of an embodiment of the closed Cover Box, over the image of the Water Flushing Button, according to the present invention.

The invention consists of a Cover Box accessory for a conventional and generic toilet with a top Water Flushing Button, either single flush or dual flush. This Cover Box is formed by two main parts: a Fixed Base and a Sliding Top. The Fixed Base would ideally be made of acrylic material. The Fixed Base is placed from the front to the back of the toilet lid, leaving the Water Flushing Button of the water discharge valve of the cistern inside to allow easy access to the traditional Water Flushing Button simply by sliding the Sliding Top to release its access. In addition, this Fixed Base is adjustable to different sizes and models of toilets, and different Cover Box sizes can be provided to cover all types of variations.

The ideal height of the Cover Box is between 1 to 2 centimeters. The Fixed Base has two lateral Fitting Guides that allow the horizontal sliding of the Sliding Top in the direction of the toilet lid or lid and seat, with the objective of closing it by the impact of opening the Sliding Top to press the Water Flushing Button. For this to happen smoothly, the toilet seat and lid hinges must be "Soft Close" hinges. Adjusting/manufacturing the hinges of the covers and seats for an extremely fast dropping of 2 to 3 seconds is preferred. The Sliding Top should have a transparent part and may also have an opaque part.

The tension spring is located at the bottom of the Fixed Base and is designed to make the Sliding Top return to its original position. As mentioned, other mechanisms such as elastic bands can be used instead of a spring. The objective of this system is to force the person to open the acrylic lid to activate the Water Flushing Button, which indirectly closes the toilet lid or lid and seat.

By sliding the Sliding Top, the toilet lid is indirectly closed, mechanically implementing the habit of closing the lid or sit and lid before pressing the Water Flushing Button. This system can be used in combination with the same lid and seat presented in the sequential timer system of Patent Application 1.

The Cover Box of the Water Flushing Button with combined movement to close the lid or lid and seat of the present invention significantly improves hygiene in toilet environments by preventing the emission of bioaerosols during flushing. It is easy to install and can be easily adapted to existing toilets. The application of this system can achieve a global impact (social, economic, sanitary), contributing to preventive medicine and significantly improving the level of public health worldwide. It is capable of preventing the spread of diseases of low, medium, and high complexity (in many cases lethal), in addition to contributing to the fight against a building's environmental pollution (within the household, intra-hospital, etc.).

To further enhance the effectiveness of the system, a timer can be added so that the flush is delayed for a few seconds to allow the lid to finish closing before the flush is executed. An example of implementing this timer would be to apply the Water Flushing Button described in Patent Application 1, which is hereby incorporated by reference, and includes a mechanical timer that delays the flush for a certain amount of time. Other timer systems can also be applied without departing from the spirit and scope of the present invention, which a person of ordinary skill in the art could deduce from the teachings of this specification.

The system technically achieves:

a) Completely eliminating the transmission and contagion of thousands of diseases through the fecal-oral and urine-oral routes (directly or indirectly) derived from the infectious microscopic bioaerosol column (formed by fecal particles and pathogen germs) from toilets (invisible to the naked eye), to avoid the spread and transmission of diseases.

b) Preventing in many cases deaths in all the inhabitants of the world, regardless of place, country, sex, age and purchasing power.

c) Avoiding the huge suffering of contracting some of the diseases detailed below.

d) Decreasing the death rate worldwide, and also a great economic benefit for public health: the governments of each country will spend less on hospital care.

Diseases Transmitted Via the Fecal-Oral and Urine-Oral Routes

Following is a list of mild, severe and fatal infectious diseases transmitted by the fecal-oral and urine-oral routes, through the pathogenic germs that generate them (viruses, bacteria, protozoa, etc.). It is important to highlight that this list of 47 diseases is not exhaustive and definitive. In reality, there are even more, generated by thousands of existing strains, so the number of diseases to avoid is measured in the hundreds or thousands. By way of example, in a single flushing of water, feces can contain up to 200 Rotavirus cells, 20 billion *Shigella* Bacteria and 100,000 parasite eggs.

1. Hookworm Disease

Infectious agent that produces it: nematode/worm/parasite. Hookworm disease caused by *Necator americanus. Ancylostoma duodenale. Ancylostoma* brasiliense. *Ancylostoma ceylanicum.*

Symptoms: anemia, abdominal pain, cough, bloody diarrhea, fatigue, fever, rash, excessive weight loss, lung problems, gastrointestinal problems, heart failure, etc.

Severity level: mild, severe and fatal.

2. Balantidiasis

Infectious agent that produces it: protozoon. *Balantidium coli.*

Symptoms: diarrhea with blood and pus, nausea and vomiting, excessive weight loss, severe dehydration, high fever, headache, etc.

Severity level: mild, severe and fatal.

3. Botulism

Infectious agent that produces it: bacteria. *Clostridium botulinum*

Symptoms: abdominal pain, constipation, vomiting, fatigue, blurred or double vision, difficulty speaking, swallowing and breathing, muscle paralysis, loss of reflexes, etc.

Severity level: mild, severe and fatal.

4. Mononucleosis

Infectious agent that produces it: virus. Cytomegalovirus.

Symptoms: fever, fatigue, sore throat, muscle aches, etc.

Severity level: mild, severe and fatal.

5. Cholera

Infectious agent that produces it: bacteria. *Vibrio cholerae.*

Symptoms: intense diarrhea, severe dehydration, vomiting, muscle cramps, hypovolemic shock, blood pressure alteration, etc.

Severity level: mild, severe and fatal.

6. Ebola
Infectious agent that produces it: virus. Ebola virus.
Symptoms: pain in the abdomen, headache, throat, joints, muscles and chest. Dehydration, fever, diarrhea, vomiting blood, coughing up blood, etc.
Severity level: mild, severe and fatal.
7. Strongyloidiasis
Infectious agent that produces it: ascarid. *Strongyloides stercoralis.*
Symptoms: cough, rash, diarrhea, vomiting, etc.
Severity level: mild, severe and fatal.
8. Bacillary and Amoebic Dysentery
Infectious agent that produces it: bacteria. *Shigella* for Bacillary Dysentery, and Amoeba called *Entamoeba histolytica* for Amebic Dysentery.
Symptoms: bloody diarrhea, abdominal pain, colic, fever, dehydration, cramps, excessive weight loss, etc.
Severity level: mild, severe and fatal.
9. Enteritis Caused by Rotavirus
Infectious agent that produces it: virus. Rotavirus.
Symptoms: abdominal pain, cramps, colic, excessive weight loss, watery diarrhea, vomiting, dehydration, high fever, etc.
Severity level: mild, severe and fatal.
10. Enteritis caused by Adenovirus
Infectious agent that produces it: virus. Adenovirus.
Symptoms: diarrhea, abdominal pain, blood in the urine, bladder pain, high fever, etc.
Severity level: mild, severe and fatal.
11. Enteritis Caused by *Campylobacter*
Infectious agent that produces it: virus. *Campylobacter.*
Symptoms: diarrhea, abdominal pain, blood in the urine, bladder pain, high fever, etc.
Severity level: mild, severe and fatal.
12. Enteritis Caused by *Yersinia Enterocolitica*
Infectious agent that produces it: bacteria. *Yersinia.*
Symptoms: diarrhea, abdominal pain, blood in the urine, bladder pain, high fever, etc.
Severity level: mild, severe and fatal.
13. Enterocolitis Caused by *Clostridium Difficile*
Infectious agent that produces it: bacteria. *Clostridium difficile.*
Symptoms: diarrhea, abdominal pain, blood in the urine, bladder pain, high fever, etc.
Severity level: mild, severe and fatal.
14. Enterocolitis Caused by Enterovirus
Infectious agent that produces it: virus. Enterovirus.
Symptoms: diarrhea, abdominal pain, blood in the urine, bladder pain, high fever, etc.
Severity level: mild, severe and fatal.
15. Norwalk Gastroenteritis
Infectious agent that produces it: virus. Norwalk.
Symptoms: diarrhea, abdominal pain, blood in the urine, bladder pain, high fever, etc.
Severity level: mild, severe and fatal.
16. Acute Viral Gastroenteritis
Infectious agent that produces it: virus. Norovirus.
Symptoms: diarrhea, abdominal pain, blood in the urine, bladder pain, high fever, etc.
Severity level: mild, severe and fatal.
17. Acute Bacterial Gastroenteritis
Infectious agent that produces it: bacteria. *Helicobacter pylori* (high degree of lethality).
Symptoms: diarrhea, abdominal pain, blood in the urine, bladder pain, high fever, etc.
Severity level: mild, severe and fatal.
18. Giardiasis
Infectious agent that produces it: protozoan parasite. Giardia.
Symptoms: chronic diarrhea, impaired mental and physical development, lactose intolerance, etc.
Severity level: mild, severe and fatal.
19. Hantavirus
Infectious agent that produces it: virus. Hantaviridae.
Symptoms: high and hemorrhagic fever, headache, muscle aches, cough, lung problems, etc.
Severity level: mild, severe and fatal.
20. Hepatitis A
Infectious agent that produces it: Highly contagious liver infection caused by the Hepatitis A virus.
Symptoms: Symptoms include fatigue, nausea, abdominal pain, loss of appetite, and low-grade fever. Joint pain, headache, inflammation of the liver.
Severity level: mild, severe and fatal.
21. Hepatitis B
Infectious agent that produces it: Serious liver infection caused by the Hepatitis B virus.
Symptoms: Symptoms include fatigue, nausea, abdominal pain, loss of appetite, and low-grade fever. Joint pain, headache, inflammation of the liver. Cirrhosis, liver cancer.
Severity level: mild, severe and fatal.
22. Hepatitis E
Infectious agent that produces it: Liver disease caused by the Hepatitis E virus.
Symptoms: Symptoms include jaundice, lack of appetite, and nausea.
Severity level: mild, severe and fatal.
23. Enterohemorrhagic *Escherichia coli*
Infectious agent that produces it: bacteria. *E. coli*
Symptoms: Cramps, abdominal pain, diarrhea, severe bleeding, intestinal infections, etc.
Severity level: mild, severe and fatal.
24. Enteroinvasive *Escherichia coli*
Infectious agent that produces it: bacteria. *Escherichia coli*
Symptoms: Cramps, abdominal pain, diarrhea, severe bleeding, intestinal infections, etc.
Severity level: mild, severe and fatal.
25. Enteropathogenic *Escherichia coli*
Infectious agent that produces it: bacteria. *Escherichia coli*
Symptoms: Cramps, abdominal pain, diarrhea, severe bleeding, intestinal infections, etc.
Severity level: mild, severe and fatal.
26. *Escherichia coli* Enterotoxins
Infectious agent that produces it: bacteria. *Escherichia coli*
Symptoms: Cramps, abdominal pain, diarrhea, severe bleeding, intestinal infections, etc.
Severity level: mild, severe and fatal.
27. Enteroaggregative *Escherichia coli*
Infectious agent that produces it: bacteria. *Escherichia coli*
Symptoms: Cramps, abdominal pain, diarrhea, severe bleeding, intestinal infections, etc.
Severity level: mild, severe and fatal.
28. *Escherichia coli* Diffuse Adhesion
Infectious agent that produces it: bacteria. *Escherichia coli*
Symptoms: Cramps, abdominal pain, diarrhea, severe bleeding, intestinal infections, etc.
Severity level: mild, severe and fatal.
29. Cryptosporidiosis Infectious agent that produces it: parasite. *Cryptosporidium.*
Symptoms: diarrhea, abdominal pain, blood in the urine, bladder pain, high fever, etc.
Severity level: mild, severe and fatal.
30. *Isospora*
Infectious agent that produces it: parasite. *Isospora Belli.*
Symptoms: diarrhea, abdominal pain, fever, dehydration, etc.
Severity level: mild, severe and fatal.
31. *Bacillus cereus*
Infectious agent that produces it: bacteria. *Bacillus Cereus.*
Symptoms: emetic syndrome or diarrheal syndrome. Fever, dehydration, abdominal pain, headache, bloody stools, abdominal cramps, poisoning, etc.
Severity level: mild, severe and fatal.
32. *Clostridium perfringens*
Infectious agent that produces it: bacteria with eight lethal toxins. *Clostridium.*
Symptoms: watery diarrhea, nausea, colic, abdominal pain, headache, poisoning, etc.
Severity level: mild, severe and fatal.
33. *Staphylococcus*
Infectious agent that produces it: bacteria. Bacilli.
Symptoms: skin infections, boils, blood infections, bone infections, lung infections, poisoning, etc.
Severity level: mild, severe and fatal.
34. *Klebsiella*
Infectious agent that produces it: bacteria. *pneumoniae.*
Symptoms: urinary and biliary tract infections, osteomyelitis, meningitis, septicemia, pneumonia, fever, tachycardia, etc.
Severity level: mild, severe and fatal.
35. Malaria
Infectious agent that produces it: parasite. *Plasmodium.*
Symptoms: abdominal pain, muscle pain. Fatigue, fever, tremors, diarrhea, vomiting, headache, tachycardia, confusion, etc.
Severity level: mild, severe and fatal.
36. Epidemic Pleurodynia or Bornholm Disease
Infectious agent that produces it: virus. Enterovirus.
Symptoms: intense pleural and chest pain. Abdominal pain, fever, myocarditis, etc.
Severity level: mild, severe and fatal.
37. Salmonellosis
Infectious agent that produces it: bacteria. *Salmonella.*
Symptoms: diarrhea, fever, abdominal pain, muscle pain and headache, dehydration, bloody diarrhea, excessive weight loss, fatigue, chills, etc.
Severity level: mild, severe and fatal.
38. Poliomielitis
Infectious agent that produces it: virus. poliovirus.
Symptoms: atrophy, fatigue, fever, dizziness, muscle loss, slow growth, headaches, nausea, vomiting.
Severity level: mild, severe and fatal.
39. Rubella
Infectious agent that produces it: virus. Rubella.
Symptoms: fever, nasal congestion, headache, body aches, enlarged neck lymph nodes, body rashes, cardiac disorders, diabetes, thyroid dysfunction, etc.
Severity level: mild and severe.
40. Typhoid Fever
Infectious agent that produces it: bacteria. *Salmonella typhi.*
Symptoms: abdominal pain, muscle aches, headaches, diarrhea, vomiting, fever, fatigue, chills, extreme weight loss, etc.
Severity level: mild, severe and fatal.
41. Shigellosis
Infectious agent that produces it: bacteria. *Shigella.* It has 3 strains.
Symptoms: bloody diarrhea, abdominal pain, headache, intestinal fever.
Severity level: mild, severe and fatal.
42. Trachoma
Infectious agent that produces it: bacteria. *Chlamydia trachomatis.*
Symptoms: blindness (main infectious disease globally). Other symptoms: conjunctivitis, eye irritations.
Severity level: mild and severe.
43. Trichuriasis
Infectious agent that produces it: parasite. *Trichuris trichiura.*
Symptoms: abdominal pain, anemia, malnutrition, bloody diarrhea, rectal prolapse, etc.
Severity level: mild, severe and fatal.
44. Tuberculosis
Infectious agent that produces it: bacteria. Koch's *bacillus.*
Symptoms: chest pain, headache, coughing up blood, fatigue, fever, loss of appetite, breathing difficulties, swollen lymph nodes, weight loss, etc.
Severity level: mild, severe and fatal.
45. *Vibrio parahaemolyticus* Gastroenteritis
Infectious agent that produces it: bacteria. *Vibrio parahaemolyticus.*
Symptoms: diarrhea, abdominal and headache pain, nausea, vomiting, fever etc.
Severity level: mild, severe and fatal.
46. Intestinal or extraintestinal yersiniosis
Infectious agent that produces it: bacteria. *Yersinia.*
Symptoms: severe diarrhea, fever, cramps, intestinal pain, etc.
Severity level: mild, severe and fatal.
47. COVID-19
Infectious agent that produces it: infectious disease caused by the SARS-CoV-2 virus.
Symptoms: headache, shortness of breath, chills, muscle aches, pneumonia, fever, cough, tiredness, loss of taste or smell.
Severity level: mild, severe and fatal.

Superbugs

The World Health Organization (WHO) has published a list of superbugs for which new antibiotics are urgently needed. The list includes the 12 most dangerous and deadly families of bacteria worldwide, 7 of which will be mentioned below as they can be transmitted via the fecal-oral route, and 2 via the fecal-oral and urine-oral route. Said published list is a new tool to guarantee that research and development, such as the work carried out in this patent where we developed a preventive product for disease transmission and a complement to medication, responds to urgent global public health needs.

The WHO divides them into three categories based on the urgency in which new antibiotics, drugs, etc. are needed: critical, high or medium priority.

The critical priority group includes multi-resistant bacteria that can cause serious and often fatal infections, such as bloodstream infections and pneumonia.

The second and third levels of the list (the high and medium priority categories) contain other bacteria that exhibit increasing drug resistance and cause common diseases and food poisoning such as *Salmonella*, etc.

Predictions suggest that by the year 2050 superbugs can cause 10 million deaths per year worldwide and many of these diseases are of great concern and impact for the United States, for instance.

Priority 1: CRITICAL

- *Acinetobacter baumannii*, carbapenem-resistant: Can be transmitted via fecal-oral or urine-oral route.
- *Pseudomonas aeruginosa*, carbapenem-resistant: Can be transmitted via fecal-oral or urine-oral route.
- Enterobacteriaceae, carbapenem-resistant, ESBL producers: Can be transmitted by the fecal-oral route.

Priority 2: HIGH

- *Enterococcus faecium*, vancomycin-resistant: Can be transmitted via fecal-oral route.
- *Staphylococcus aureus*, methicillin-resistant (MRSA), with intermediate sensitivity and resistance to vancomycin: Can be transmitted via fecal-oral route.
- *Helicobacter pylori*, clarithromycin-resistant: An infectious agent mentioned earlier in the List of Diseases. Can be transmitted via fecal-oral route.
- *Campylobacter* spp., fluoroquinolone-resistant: A disease mentioned earlier in the List of Diseases. Can be transmitted via fecal-oral route.
- Salmonellae, fluoroquinolone-resistant: A disease mentioned earlier in the List of Diseases. Can be transmitted via fecal-oral route.

Priority 3: MEDIUM

- *Shigella*, fluoroquinolones-resistant: A disease already mentioned above in the List of Diseases. It can be transmitted by the fecal-oral route.

In addition, outside the WHO list, there is a strain of superbug called CRE that belongs to the group of Enterobacteriaceae, carbapenems-resistant and is lethal in 50% of cases. It is of great concern to public health because current drugs (between 26 and 28 antibiotics used) do not provide the required result. This strain was classified as a "Nightmare Bacteria" by the Director of the US Centers for Disease Control and Prevention (CDC), Tom Frieden. The CRE superbug can be transmitted through fecal-oral and urine-oral routes. The West Virginia Public Health Office indicated that infected patients often have the bacteria on their skin or hands and spread it through urine, feces, or wounds.

Some general aspects of the present invention have been summarized so far in the first part of this detailed description and in the previous sections of this disclosure. Hereinafter, a detailed description of the invention as illustrated in the drawings will be provided. While some aspects of the invention will be described in connection with these drawings, it is to be understood that the disclosed embodiments are merely illustrative of the invention, which may be embodied in various forms. The specific materials, methods, structures, and functional details disclosed herein are not to be interpreted as limiting. Instead, the intended function of this disclosure is to exemplify some of the ways—including the presently preferred ways—in which the invention, as defined by the claims, can be enabled for a Person of Ordinary Skill in the Art. Therefore, the intent of the present disclosure is to cover all variations encompassed within the spirit and scope of the invention as defined by the appended claims, and any reasonable equivalents thereof.

With reference to the drawings in more detail, FIG. 1 presents a rear view of the closed Cover Box, which consists of an acrylic Cover Box 1. It is important to note that, although illustrated with acrylic material, it can also be made of other materials. The Cover Box 1 has a suitable size to be placed over the top of the toilet cistern and when its movable part, the Sliding Top 4, is moved, the toilet lid (or seat and lid) closes. The Cover Box 1 is comprised of an opaque non-sliding acrylic Fixed Base 2, which has a back 5. This is inserted inside a Sliding Top 4 which has a Transparent Acrylic Sliding Plaque 4*a*, an Opaque Acrylic Sliding Plaque 4*b*, two Sliding Side Walls 4*c*, and a Sliding Front 4*d*. This combination of acrylics for the Sliding Top 4 could have different designs, such as a transparent circle in the middle, or any shape, or even be completely transparent. This design has the advantage of allowing the Water Flushing Button 6 of the toilet to be visible while covering the spring, giving it a more aesthetic appearance. The importance of the translucent or transparent material is that it allows the user to see the Water Flushing Button 6 without having to open the lid, in order to understand its location and deduce that the Sliding Top 4 must be slid to activate it. Similarly, in some embodiments, the same results can be achieved by inserting the Sliding Top 4 inside the fixed base 2, just by inverting the design. This Sliding Top, composed of components 4*a* to 4*d*, slides in the direction of movement 3, as shown in FIG. 2, to allow access to the Water Flushing Button 6 and, in this way, the toilet can be flushed.

Figure 2:
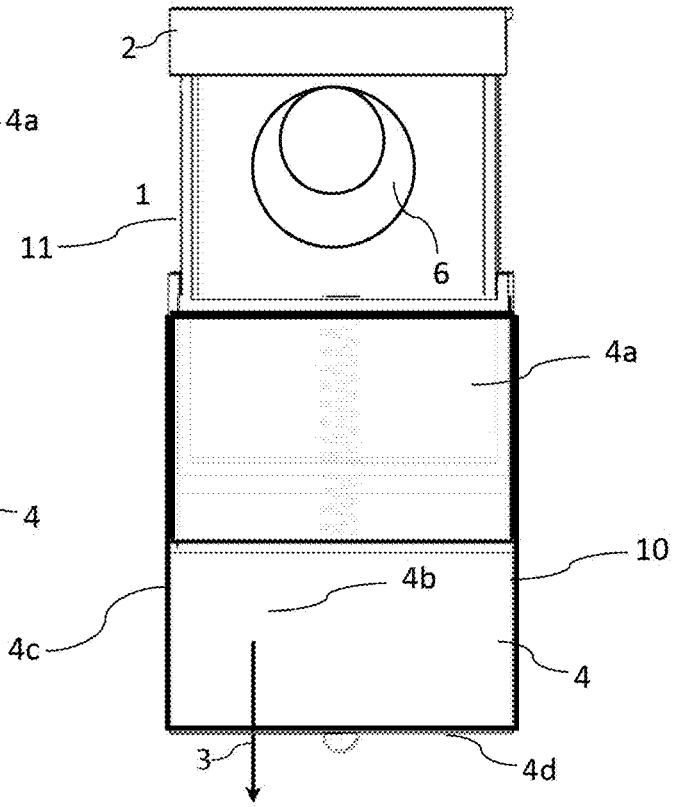
FIG. 2 is a rear view of an embodiment of the open Cover Box, over the image of the Water Flushing Button, according to the present invention.

In FIG. 2, the Sliding Top 4 has been slid, with elements 4*a* to 4*d* moved in the direction of movement shown by 3, which is the same direction as the toilet lid, and that will cause it to close. The opaque non-sliding Fixed Base 2 is in its original position, while the Sliding Top 4 has been slid in the direction of movement 3 to access the Water Flushing Button 6. In addition, the Lateral wall 11 that is part of the Fixed Base 2 of Cover Box 1 is shown, as it remains in place when the Sliding Top 4 slides. FIG. 2 allows a clear visualization of how the Cover Box 1 opens to access the Water Flushing Button 6, allowing easy use of the product.

Figure 3:
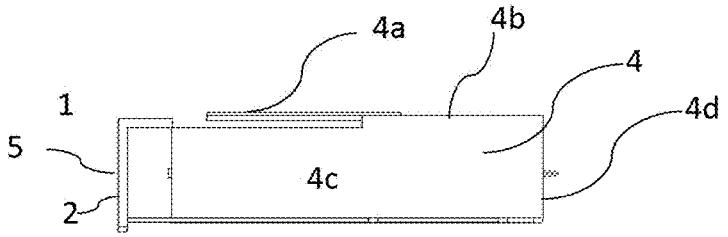
FIG. 3 is a side view of an embodiment of the closed Cover Box, according to the present invention.

In FIG. 3, a side view of the closed Cover Box is shown, in which the Cover Box 1 and opaque non-sliding Fixed Base 2 can be identified. The Fixed Base 2 keeps Cover Box 1 closed and secure in its position while the Sliding Top 4 moves.

Figure 4:
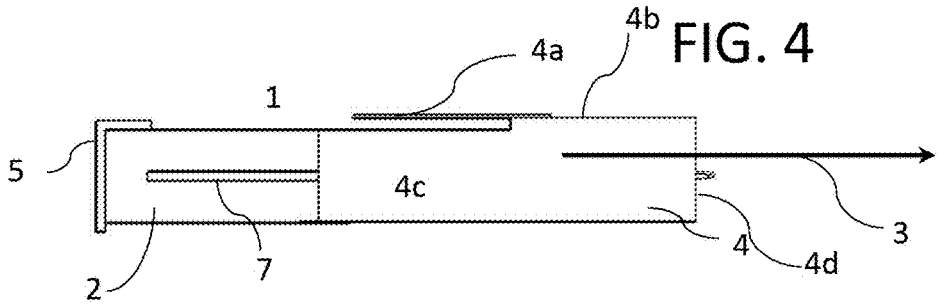
FIG. 4 is a side view of an embodiment of the open Cover Box, according to the present invention.

In FIG. 4, a side view of the open Cover Box is shown, in which the Cover Box 1 can be identified, which is made of a material suitable for use in a humid environment. Here, the Sliding Top 4 has been slid in the direction of movement 3 to allow access to the Water Flushing Button 6. The Fitting Guide 7 is on the side walls of the Fixed Base 2, and a Sliding Fitting 8 present on the inner face of the opaque Sliding Side Walls 4*c* is inserted into it, responsible for guiding the movement of the Sliding Top 4 in the direction of movement 3, i.e., towards where the toilet lid closes. In this way, controlled and safe opening of the Cover Box is allowed, allowing the user to efficiently access the Water Flushing Button 6.

Figure 5:
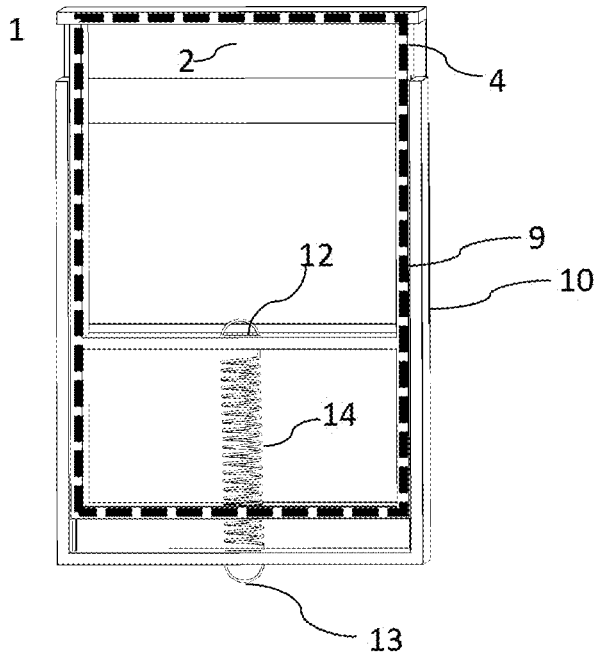
FIG. 5 is a bottom view of an embodiment of the closed Cover Box, according to the present invention.
Figure 6:
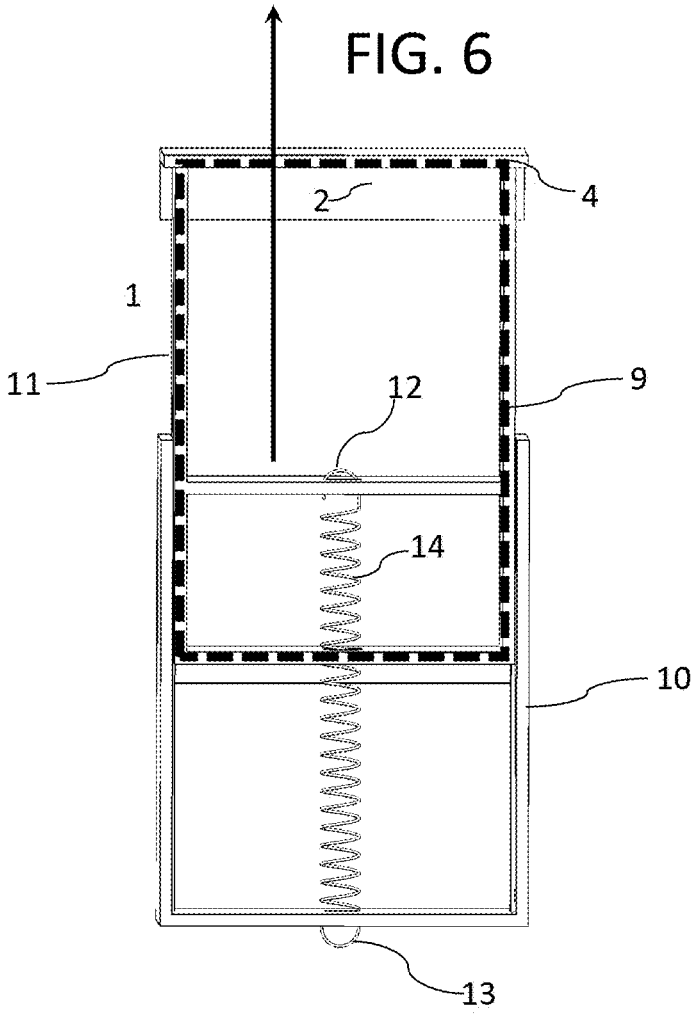
FIG. 6 is a bottom view of an embodiment of the open Cover Box, according to the present invention.

FIGS. 5 and 6 show the bottom view of the embodiment, respectively, in its closed and open state. In both, the presence of a Tension Spring 14 can be appreciated, which plays an important role in the operation of the acrylic Cover Box 1. Other traction means, such as an elastic band, can be used instead of the spring. In FIG. 5, the following parts can be identified: Cover Box 1, opaque non-sliding Fixed Base 2, Sliding Top 4, external side 10, Tension Spring 14 in the compressed state, tension spring Support 12, and tension spring Stopper 13. The Placement Base 9, marked with a black rectangle, is the surface on which an adhesive must be applied to fix the Cover Box 1 to the top of the toilet cistern. The fixing way can vary, with the use of glue or a special adhesive for sanitary porcelain or ceramic tiles, such as "Devcon2-Ton Epoxy", being effective. In FIG. 6, in addition to the parts mentioned in FIG. 5, the internal side 11 and the tension spring 14 in its extended state can be identified.

Figure 7:
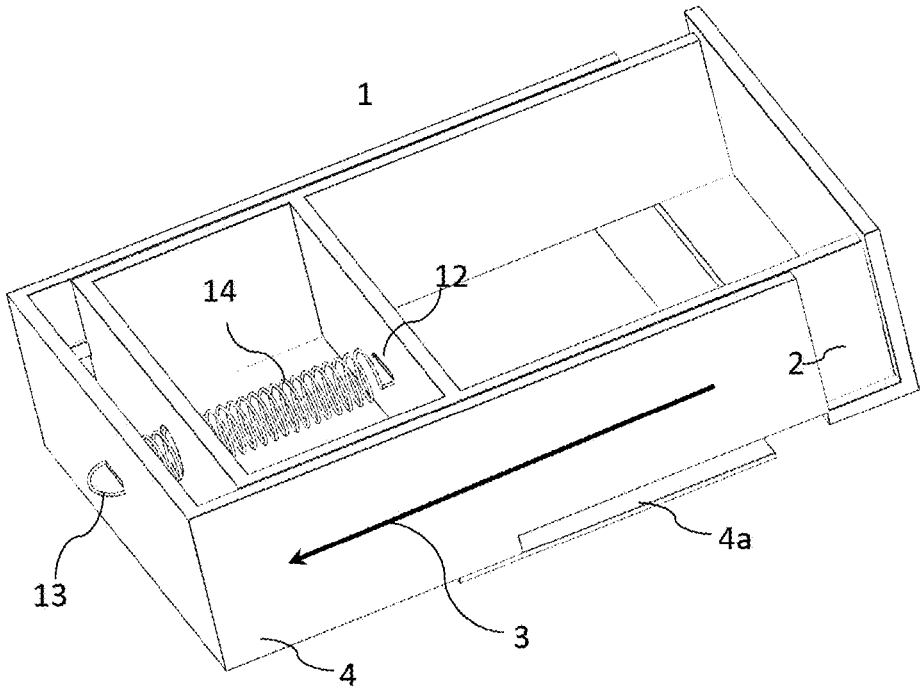
FIG. 7 is a perspective view from below of an embodiment of the closed Cover Box, according to the present invention.
Figure 8:
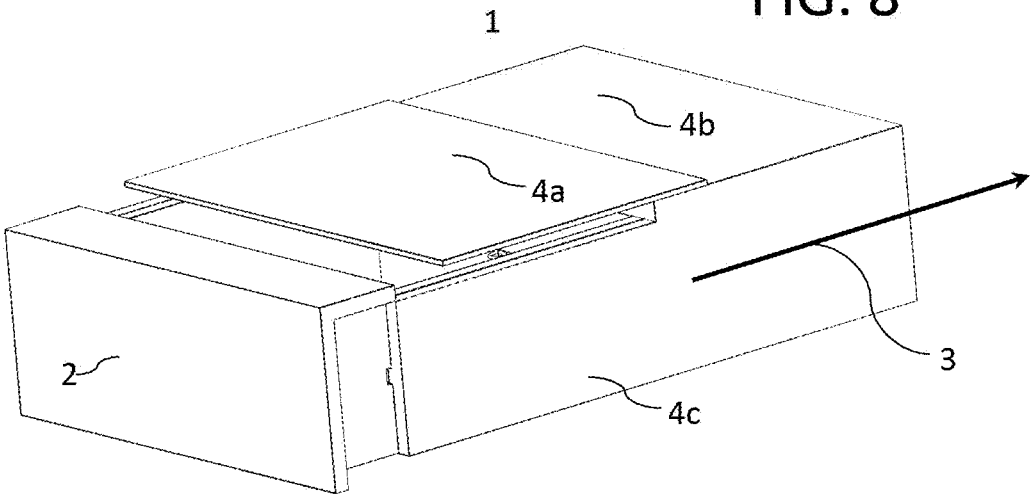
FIG. 8 is a perspective view from above of an embodiment of the closed Cover Box, according to the present invention.

FIGS. 7 and 8 show the closed Cover Box 1 in perspective from different angles, which makes it possible to appreciate the shape and operation of the Cover Box 1 in a three-dimensional representation. FIG. 7 offers a bottom view where the arrangement of the Cover Box components, the tension spring Support 12, the tension spring Stopper 13, and the compressed Tension Spring 14 can be seen. FIG. 8, on the other hand, shows the Cover Box from the top, where the arrangement of the Cover Box 1, the opaque non-sliding Fixed Base 2, the direction of movement 3, and the Sliding Top 4 can be observed. Together, these figures offer a complete and detailed representation of the Cover Box.

Figure 9:
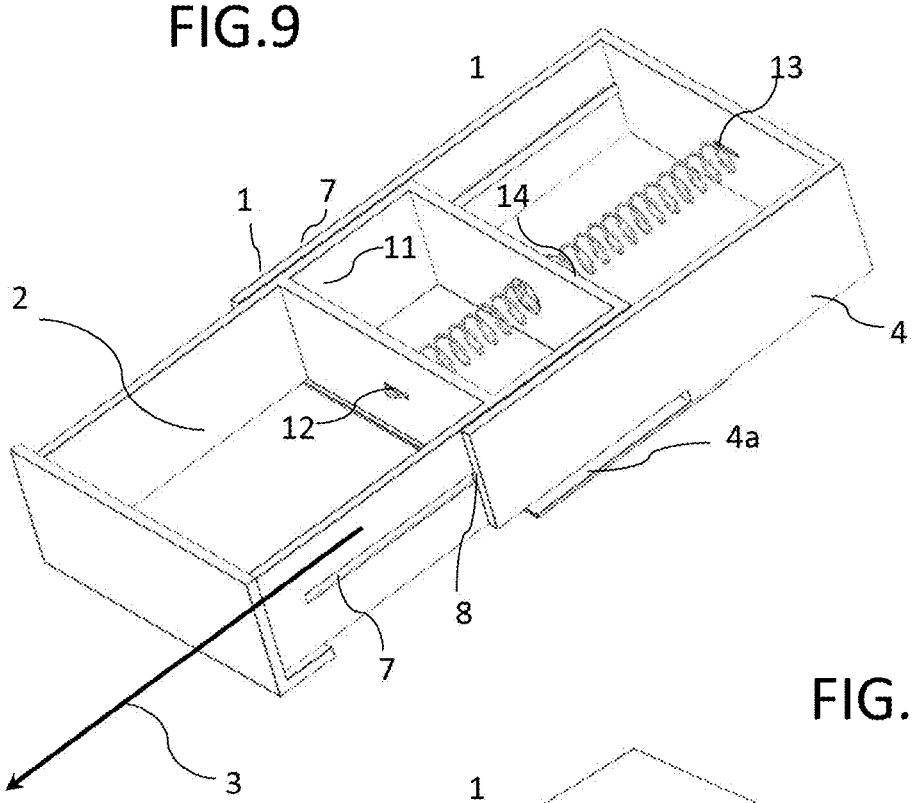
FIG. 9 is a perspective view from below of an embodiment of the open Cover Box, according to the present invention.
Figure 10:
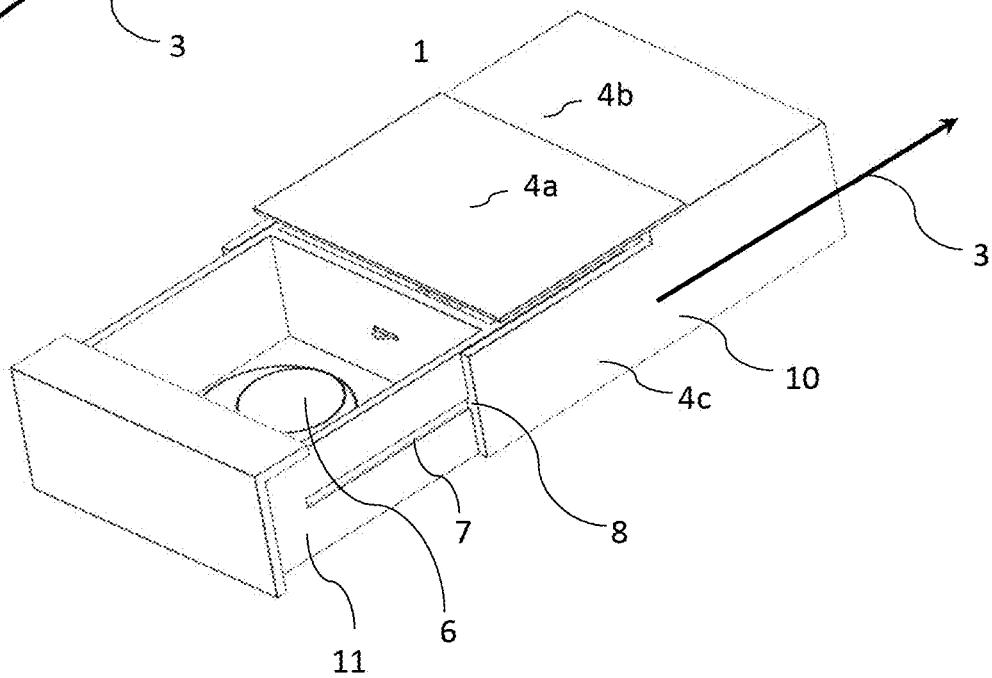
FIG. 10 is a perspective view from above of an embodiment of the open Cover Box, according to the present invention.

FIGS. 9 and 10, in turn, are also perspective views of the Cover Box 1, but this time with the Cover Box 1 open. FIG. 9 presents a bottom view that allows the appreciation of the Cover Box components, including the acrylic Cover Box 1, opaque non-sliding Fixed Base 2, the direction of movement 3, the Sliding Top 4, the Fitting Guide 7, the Sliding Fitting 8, the internal side 11, the tension spring Support 12, the tension spring Stopper 13, and the extended Tension Spring 14. FIG. 10, on the other hand, offers a view from above and shows the Cover Box 1, the direction of movement 3, the Sliding Top 4, the Fitting Guide 7, the Sliding Fitting 8, the reference location of the Water Flushing Button 6, the external side 10, and the internal side 11. Together, these figures provide a clear and detailed representation of the Cover Box when it is open.

FIGS. 11 and 12 show a traditional top flushing toilet with a cistern, with the acrylic Cover Box 1 applied. FIG. 11 shows the Cover Box 1 closed, and FIG. 12 shows the Cover Box open. The parts visible in both figures are: Cover Box 1, opaque Sliding Top 4, Toilet 15, Cistern 16, Toilet lid 17, and Seat 18. In these figures, it can be seen how the acrylic Cover Box 1 is applied to the toilet 15 and covers the parts above the cistern 16, and how when it is opened in the direction of movement 3, it pushes the lid 17 until it closes it. When the Sliding Top 4 is moved forward it allows the user to access the Water Flushing Button 6.

The importance of having the Cover Box in the toilet lies in the need to necessarily close the lid 17 or lid 17 and seat 18 to activate the flush, preventing the dispersion of microorganisms that occur when the lid is open and the flush is activated. In this way, the Cover Box allows for greater hygiene and safety in the use of the toilet.

Finally, in FIGS. 13 and 14, side views of the toilet with the Cover Box 1 applied are shown. In FIG. 13, the Cover Box 1 is closed, and the toilet lid 17 is open. In FIG. 14 Cover Box 1 is open, and the toilet lid 17 is semi-closed because it closes as a result of the push received when the Cover Box 1 is opened.

In FIG. 13, the following parts can be seen: Cover Box 1, Sliding Top 4, Toilet 15, Cistern 16, Toilet lid 17, and Seat 18. In FIG. 14, in addition to the direction of movement 3, the Sliding Top 4 and the sliding Fitting Guide 7 can be seen. These figures demonstrate how the Cover Box 1 is applied to the top of the cistern 16 of toilet 15. The lid 17 is closed due to the push received when the Cover Box is opened, which prevents the release of microorganisms that occur when the toilet's lid is left open during flushing.

The description as set forth is not intended to be exhaustive or to limit the invention to the precise form disclosed. Many modifications and variations are possible in light of the teachings above without departing from the spirit and scope of the forthcoming claims.

The invention claimed is:

1. A toilet water flushing button cover box system comprising:

a) a toilet comprising:
  a lid
  at least one water flushing button; and
  a cistern; and b) a toilet water flushing button cover box comprising:
  a fixed base;
  a sliding top; and
  means for returning the sliding top to an initial position when released;

wherein said fixed base comprises a placement base for adhering the cover box to the cistern;

wherein when said cover box is installed surrounding the at least one water flushing button;

wherein when the sliding top is moved to allow access to the at least one water flushing button, said lid is forced to close;

wherein said means for returning the sliding top to the initial position when released comprise a tension spring attached to said fixed base by a support and to said sliding top by a stopper;

wherein said at least one water flushing button can be seen through said sliding top; and wherein said fixed base comprises fitting guides and said sliding top comprises sliding fittings for guiding a sliding movement of the sliding top towards the lid of said toilet, so that when the sliding top is moved to allow access to the at least one water flushing button, said lid is forced to close.

2. The toilet water flushing button cover box system of claim 1, to which a mechanical timer is added to delay the water flush for an amount of time which is sufficient for the lid to be fully closed before flushing.

* * * * *